US007047571B1

(12) United States Patent
Kelly

(10) Patent No.: US 7,047,571 B1
(45) Date of Patent: May 23, 2006

(54) PONYTAIL CAP

(76) Inventor: Barbara Ann Kelly, P.O. Box 115 31284 170th St., Huntly, MN (US) 55604

( * ) Notice: Subject to any disclaimer, the term of this patent is extended or adjusted under 35 U.S.C. 154(b) by 0 days.

(21) Appl. No.: 10/957,475

(22) Filed: Oct. 1, 2004

(51) Int. Cl.
*A42B 1/24* (2006.01)

(52) U.S. Cl. ..... 2/209.13; 2/174; 132/54

(58) Field of Classification Search ..... 2/209.13, 2/174; 132/53, 54
See application file for complete search history.

(56) References Cited

U.S. PATENT DOCUMENTS 2,897,511 A * 8/1959 Blair ..... 2/209.13
5,170,509 A 12/1992 Leopold
5,239,705 A 8/1993 Leopold
5,493,735 A * 2/1996 Rice ..... 2/209.13
5,819,319 A 10/1998 Spurs

* cited by examiner

*Primary Examiner*—Katherine M. Moran
(74) *Attorney, Agent, or Firm*—Roger L. Belfay

(57) ABSTRACT

The Ponytail Cap is an apparel item comprising: a cap, a plurality of cooperating fastening means located within the cap interior, and a hair accessory piece which simulates the appearance of human hair.

13 Claims, 3 Drawing Sheets

PONYTAIL CAP

The Ponytail Cap is an apparel item comprising: a cap having a crown, a front, a rear, an initially open interior, and a plurality of cooperating fastening means located within the cap interior for matingly engaging one or more of the primary fastening means of a hair accessory piece, and a hair accessory piece which simulates the appearance of human hair.

CROSS REFERENCE TO RELATED APPLICATIONS

There are no applications related to this application.

STATEMENT REGARDING FEDERAL SPONSORSHIP

No invention claimed in this application was made under Federally sponsored research or development.

BACKGROUND OF INVENTION

A number of attempts have been made to provide a means for people to hide, disguise, or at least minimize the appearance of head hair loss. There are a number of approaches to this endeavor including wigs, hair growth therapies, surgical hair replacement, and hair pieces. Hair pieces may be attached: to the users existing hair, to the wearer's head with adhesives or friction fit elastic devices, or to a hat or other piece of wearing apparel for the head in such a way that the wearer disguises the loss of head hair. The present invention embodies an item of wearing apparel in which a hair piece is removably attached to a cap or other item of wearing apparel for the head.

Many existing items achieve the attachment of a hair piece to a hat or cap by providing fastening means along the lower periphery of the hat or cap. Examples of this approach are U.S. Pat. No. 5,819,319 to Spurs, U.S. Pat. No. 5,493,735, to Rice, U.S. Pat. No. 4,804,003 to Moen, U.S. Pat. No. 4,599,749 to Childs et al., U.S. Pat. No. 4,492,242 to Dalton, U.S. Pat. No. 3,782,396 to Tomlinson, U.S. Pat. No. 3,636,962 to Frackowiak, U.S. Pat. No. 3,557,806 to Blanchard, U.S. Pat. No. 3,460,546 to Abbott, U.S. Pat. No. 2,889,557 to Blair, U.S. Pat. No. 2,651,310 to Selson, U.S. Pat. No. 2,574,558 to Graber et al., and U.S. Pat. No. 2,567,119 to Naidor.

Another approach attaches a hair piece to the exterior of the hat or cap and disguises the attachment with ornamentation. Examples of this class are U.S. Pat. Nos. 5,239,705, and 5,170,509 to Leopold.

A third approach attaches the hair piece at the upper periphery of the hat or cap as in U.S. Pat. No. 3,910,292 to Izzo and U.S. Pat. No. 3,295,536 to Shaw et al.

The present invention provides an attachment means located sufficiently distant from the periphery of the hat or cap and interior thereto permitting a concealed and gradual transition from the periphery of the cap or hat to the attachment means. The concealed and gradual transition permits a gradual taper from the thickness of the hair piece at the periphery of the cap or hat to a minimal thickness at the attachment means. This taper of the hair piece provides a more natural appearance for the wearer.

BRIEF SUMMARY OF THE INVENTION

The Ponytail Cap is an apparel item comprising: a cap having a crown, a front, a rear, an initially open interior which is defined between the crown and a lower peripheral edge, and a plurality of cooperating fastening means located within the cap interior for matingly engaging one or more of the primary fastening means of a hair accessory piece, and a hair accessory piece which simulates the appearance of human hair. In typical use the wearer's hair will be visible below the lower periphery of The Ponytail Cap.

The hair accessory piece has an upper portion and a normally exposed lower portion, the upper portion includes a primary fastening means for removably installing the hair accessory piece within the initially open interior of the cap. The cooperating fastening means is placed a sufficient distance inward from the lower periphery of the cap to allow for a smooth transition from the full thickness of the hair piece to a reduced thickness of the hairpiece at the attachment point.

The fastening means optionally includes an adjustment region for varying the extent of exposure of the normally exposed lower portion of the hair accessory piece.

It is an object of this invention to provide a means for people to hide, disguise, or at least minimize the appearance of head hair loss. It is a further objective of this invention to provide a means for people to experience a temporary change of appearance or to easily deal with a bad hair day.

DETAILED DESCRIPTION

Figure 1:
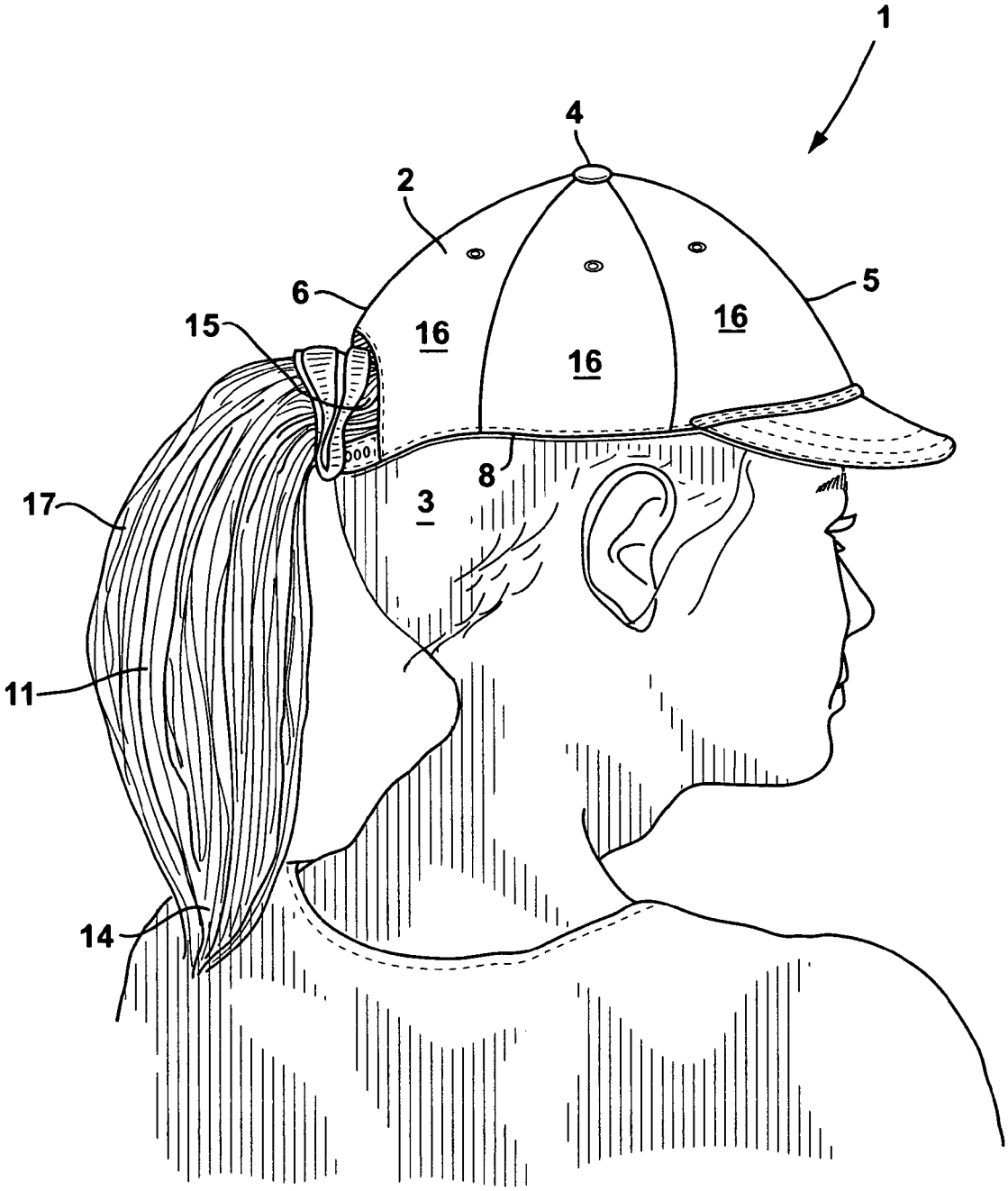
FIG. 1 is a perspective view of the Ponytail Cap, in use.
Figure 2:
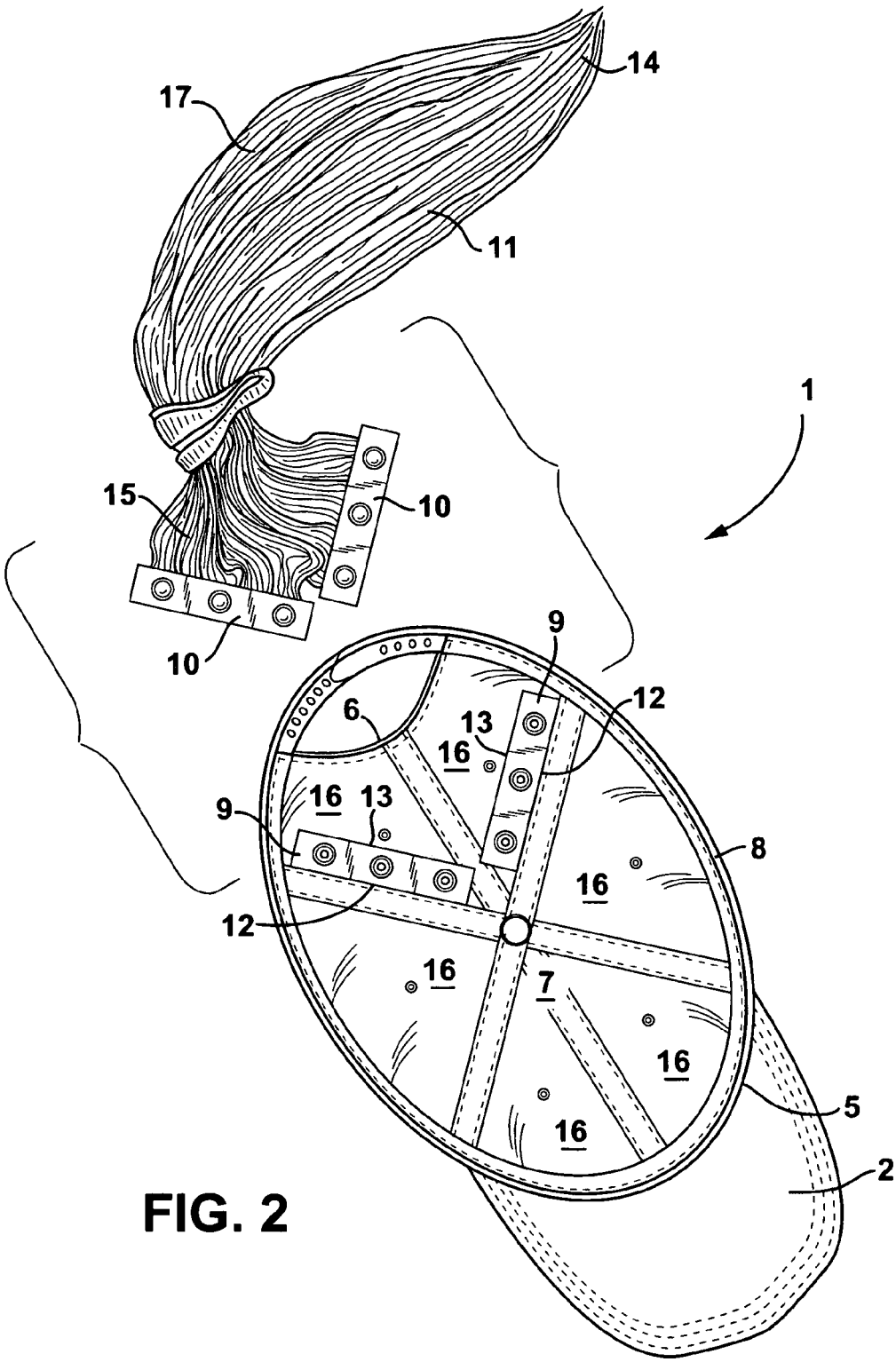
FIG. 2 is an exploded bottom view of the preferred embodiment shown in FIG. 1.
Figure 3:
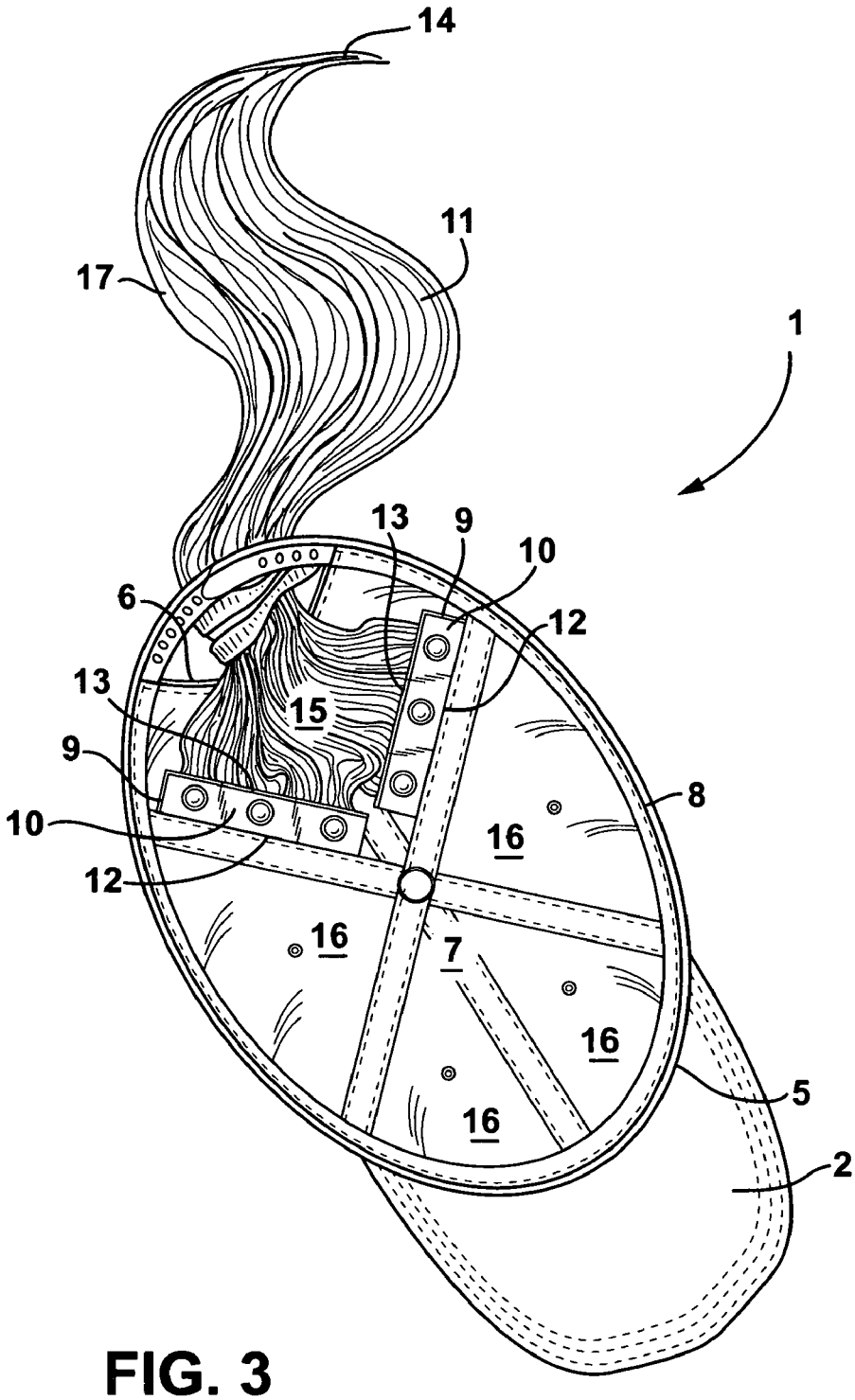
FIG. 3 is an assembled bottom view of the preferred embodiment shown in FIG. 1.

The Ponytail Cap 1 is an apparel item comprising: a cap 2 intended to be worn on a wearer's head 3, the cap 2 having a crown 4, a front 5 and a rear 6, an initially open interior 7 which is defined between the crown 4 and a lower peripheral edge 8, and a plurality of cooperating fastening means 9 located within the cap 2 interior 7 for matingly engaging one or more of the primary fastening means 10 of a hair accessory piece 11, said cooperating fastening means 9 having a first edge 12 and a second edge 13, said first edge 12 being permanently attached to the interior 7 of said cap 2, a selected one of the primary fastening means 10 and the cooperating fastening means 9 optionally including an adjustment region for varying the extent of exposure of the normally exposed lower portion 14 of the hair accessory piece 11, and a hair accessory piece 11 which simulates the appearance of human hair, the hair accessory piece 11 having an upper portion 15 and a normally exposed lower portion 14, the upper portion 15 including a primary fastening means 10 for removably installing the hair accessory piece 11 within the initially open interior 7 of the cap 2. The cap 2 may be comprised of several panels 16 stitched or other wise fastened together to form a hat. The crown 4 of the cap 2 is the highest portion of the cap 2 when worn on the head 3 of a person when the wearer's head 3 is in the upright position. Often such caps 2 are constructed of several panels 16 sewn together to produce an approximately circular lower peripheral edge 8 and an overall approximation of a hollow hemisphere with a portion left open at the rear 6 for adjustment or to allow the passage of a portion of the wearer's hair. In typical use the wearer's hair will be visible below the peripheral edge.

The Ponytail Cap 1 is intended to provide a wearer suffering partial or complete hair loss with a cap 2 and hair piece 17 which when used in conjunction can diminish or eliminate the appearance of partial or complete hair loss.

The hair piece 17 of the present invention is removable to facilitate cleaning and other maintenance activities associated with use. The primary fastening means 10 and the cooperating fastening means 9 provide this capability. The primary fastening means 10 and the cooperating fastening means 9 may be any two items which can be removably fastened together. In some cases both the primary fastening means 10 and the cooperating fastening means 9 may be the same such as hook and loop material, or the primary fastening means 10 and the cooperating fastening means 9 may be different items such as stud and cap snaps or a button and buttonhole in a strip of suitable material.

The hair piece 17 may be constructed of human hair, or other materials providing the appearance of human hair. The materials are chosen to minimize the appearance of hair loss. Color and texture match is often a consideration in the choice of materials for the hair piece 17. In the case of a user who anticipates a significant hair loss for any reason, such as chemotherapy, the user may choose to use the user's own hair salvaged for the purpose prior to the actual onset of the hair loss to provide a best color and texture match with the user's general appearance and remaining hair. The hair or other material may be attached to the primary fastening means 10 by any suitable means whatsoever comprising; gluing, stapling, and weaving. Additional intermediary parts may be included in the attachment of the hair or other suitable material to the primary fastening means 10. Any means providing a permanent or temporary attachment between the primary fastening means 10 and the hair or other suitable material is acceptable for this purpose.

The cooperating attachment means is attached to the cap 2 along its first edge 12 by any suitable means comprising: stitching, gluing, and weaving.

I claim:

1. An apparel item comprising:

a) a cap intended to be worn on a wearer's head, the cap having a crown formed from a plurality of panels, the panels stitched together forming seams between said panels, said crown having a front and a rear and having an initially open interior which is defined between the crown and a lower peripheral edge;

b) a hair accessory piece which simulates the appearance of human hair, the hair accessory piece having an upper portion and a normally exposed lower portion, the upper portion including a plurality of primary fastening means for removably installing the hair accessory piece within the initially open interior of the cap; and c) a plurality of cooperating fastening means located within the cap interior for matingly engaging at least one of the plurality of primary fastening means of the hair accessory piece, said cooperating fastening means having a first edge and a second edge, with at least one of the plurality of cooperating fastening means first edge being permanently attached at a seam between a pair of panels used in construction of the cap.

2. The apparel item of claim 1 wherein the at least one of the plurality of cooperating fastening means first edge is permanently attached by stitching.

3. The apparel item of claim 1 in which at least one of the plurality of primary attachment means includes an adjustment region for varying the extent of exposure of the normally exposed lower portion of the hair accessory piece.

4. The apparel item of claim 1 in which at least one of the plurality of cooperating attachment means includes an adjustment region for varying the extent of exposure of the normally exposed lower portion of the hair accessory piece.

5. The apparel item of claim 1 in which at least one of the plurality of primary attachment means and at least one of the plurality of cooperating attachment means interact to provide adjustment varying the extent of exposure of the normally exposed lower portion of the hair accessory piece.

6. The apparel item of claim 1 in which a portion of the hair accessory piece occupies the rear opening of the cap.

7. The apparel item of claim 6 in which at least one of the plurality of primary attachment means includes an adjustment region for varying the extent of exposure of the normally exposed lower portion of the hair accessory piece.

8. The apparel item of claim 6 in which at least one of the plurality of cooperating attachment means includes an adjustment region for varying the extent of exposure of the normally exposed lower portion of the hair accessory piece.

9. The apparel item of claim 6 in which at least one of the plurality of primary attachment means and at least one of the plurality of cooperating attachment means interact to provide adjustment varying the extent of exposure of the normally exposed lower portion of the hair accessory piece.

10. The apparel item of claim 6 wherein the at least one of the plurality of cooperating fastening means first edge is permanently attached by stitching.

11. The apparel item of claim 10 in which at least one of the plurality of primary attachment means includes an adjustment region for varying the extent of exposure of the normally exposed lower portion of the hair accessory piece.

12. The apparel item of claim 10 in which at least one of the plurality of cooperating attachment means includes an adjustment region for varying the extent of exposure of the normally exposed lower portion of the hair accessory piece.

13. The apparel item of claim 10 in which at least one of the plurality of primary attachment means and at least one of the plurality of cooperating attachment means interact to provide adjustment varying the extent of exposure of the normally exposed lower portion of the hair accessory piece.

* * * * *